US011619394B1

(12) United States Patent
Elliston et al.

(10) Patent No.: US 11,619,394 B1
(45) Date of Patent: Apr. 4, 2023

(54) COOKING DEVICES AND COMPONENTS THEREOF

(71) Applicant: SharkNinja Operating LLC, Needham, MA (US)

(72) Inventors: Rupert Elliston, London (GB); Jennifer Kathryn Marsden, London (GB); Edward Brown, London (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 17/729,984

(22) Filed: Apr. 26, 2022

(51) Int. Cl.
*F24C 15/10* (2006.01)
*F24C 7/08* (2006.01)

(52) U.S. Cl.
CPC ..... *F24C 7/083* (2013.01); *F24C 15/105* (2013.01); *F24C 15/106* (2013.01)

(58) Field of Classification Search
CPC .. F24C 7/08; F24C 7/082; F24C 7/083; F24C 7/085; F24C 15/002; F24C 15/08; F24C 15/101; F24C 15/105; F24C 15/106; F24C 15/2007; F24C 15/34; A47J 27/004; A47J 27/04; A47J 27/0802; A47J 27/086; A47J 27/09; A47J 27/092; A47J 27/10; A47J 27/12; A47J 27/14; A47J 36/02; A47J 36/04; A47J 36/06; A47J 36/10; A47J 36/12; A47J 36/16; A47J 36/165; A47J 36/32; A47J 36/321
See application file for complete search history.

(56) References Cited

U.S. PATENT DOCUMENTS

| | | | | |
|---|---|---|---|---|
| 2,936,359 | A * | 5/1960 | Sheahan | H01R 13/7137 219/441 |
| 11,035,742 | B2 * | 6/2021 | Moon | G01K 5/62 |
| 2008/0083730 | A1 * | 4/2008 | Dolgov | A47J 27/004 219/432 |
| 2018/0143083 | A1 * | 5/2018 | Pastore | G01K 1/14 |
| 2018/0317691 | A1 * | 11/2018 | Huang | A47J 27/092 |
| 2018/0352992 | A1 * | 12/2018 | Zhang | A47J 27/004 |

* cited by examiner

*Primary Examiner* — Hung D Nguyen
(74) *Attorney, Agent, or Firm* — Mintz Levin Cohn Ferris Glovsky and Popeo, PC

(57) ABSTRACT

Cooking devices, cooking systems, and sensor assemblies for use therewith are provided. In one embodiment, a cooking system is provided and includes a housing, at least one cooking container, and a sensor assembly. The housing can have a sensor port formed in an exterior surface thereof for operably coupling to a connector housing on a sensor assembly. The cooking system can further include a through-passage formed between the housing and the cooking container for receiving a cable extending from the connector housing on the sensor assembly to allow a probe coupled to a distal end of the cable to be positioned within the cooking container for measuring a temperature. In certain exemplary embodiments, the sensor port and connector housing can include features that prevent rotation of the connector housing relative to the sensor port.

20 Claims, 12 Drawing Sheets

COOKING DEVICES AND COMPONENTS THEREOF

FIELD

A countertop cooking system including a temperature probe, and methods for using the same, are provided.

BACKGROUND

Sensors can be used in a variety of cooking devices to monitor the cooking process occurring within. As an example, a temperature sensor can be used to monitor an internal temperature of a cooking chamber in order to regulate a heating element. However, certain sensors may be subject to external forces when inserted, placing strain on the electrical connection of the sensor to the main body of the cooking device.

SUMMARY

Cooking devices, cooking systems, and sensor assemblies for use therewith are provided. In one embodiment, a cooking system is provided that includes a housing, a cooking container, a through-passage, and a sensor assembly. The housing includes an internal compartment therein, at least one heating element configured to heat the internal compartment, and a sensor port arranged on an exterior of the housing. The cooking container is removably disposed within the internal compartment of the housing and defining an interior cooking volume. The through-passage is formed in at least one of a sidewall of the housing and a sidewall of the cooking container, the through-passage extending into the interior cooking volume of the cooking container. The sensor assembly includes a connector housing configured to operably mate to the sensor port, a cable extending from the connector housing and configured to pass through the through-passage and into the interior cooking volume, and a probe arranged at a distal end of the cable and configured to be positioned within the internal compartment for measuring a temperature therein.

The connector housing can have a variety of configurations to couple the connector housing to the housing. For example, in some embodiments, the housing and the connector housing can have complementary features that are configured to interact to prevent rotation of the connector housing relative to the housing. In other embodiments, the connector housing can include a projection extending outward therefrom and configured to extend into a channel in the exterior of the housing such that the channel engages the projection to prevent rotation of the connector housing relative to the housing in a first rotational direction. In certain embodiments, the channel can extend around the sensor port. In other embodiments, the connector housing can include a projecting portion extending downward from the connector housing towards the through-passage, the projecting portion can have an internal surface configured to contact an external surface of the housing when the connector housing is arranged within the sensor port to thereby orient the cable toward the through-passage.

In some embodiments, the through-passage can be defined by the sidewall of the cooking container and an internal top surface of the housing.

The housing can have a variety of configurations for various cooking operations. For example, in some embodiments, housing can further include a second internal compartment configured to receive a second cooking container therein, wherein a second interior cooking volume can be defined within an interior of the second cooking container. In other embodiments, the first cooking container and the second cooking container can be individually insertable into the first cooking compartment and the second cooking compartment respectively. In some embodiments, the first internal compartment and the second internal compartment can be fluidly separate. In certain embodiments, the at least one heating element can include a first heating element positioned within the first internal compartment and a second heating element positioned within the second internal compartment. In other embodiments, the second heating element can be configured to be selectively controlled in response to an input received from the probe when the connector housing is arranged within the sensor port.

In another exemplary embodiment, a sensor assembly is provided that includes a cable, a probe, and a connector housing. The cable has a proximal end and a distal end. The probe is coupled to the distal end of the cable. The connector housing is coupled to the proximal end of the cable. The connector housing has a first projection extending therefrom in a first direction, a second projection extending therefrom in a second direction generally perpendicular to the first direction, and an electrical pin extending therefrom in the first direction, the electrical pin extending adjacent to the first projection. When the electrical pin is disposed within a sensor port on a cooking device, the first projection is configured to prevent rotation of the connector housing about a first axis extending in the first direction, and the second projection is configured to prevent rotation of the connector housing about a second axis extending in the second direction.

The second projection can have a variety of configurations for supporting the cable. For example, in some embodiments, the second projection can include an internal surface having first and second planar portions positioned at an angle relative to one another.

In some embodiments, the electrical pin can have a length that is greater than a length of the first projection.

In certain embodiments, the cable can extend from a terminal end of the second projection.

In another exemplary embodiment, a method for cooking is provided and includes inserting a probe on a sensor assembly into a first cooking container, positioning a cable extending from the probe within a through-channel formed in an upper surface of the first cooking container, inserting a connector housing coupled to the cable into a sensor port formed in an external surface of a housing of a cooking system, and inserting the first cooking container into a first internal compartment of the housing of the cooking system such that the cable extends from the probe within the first cooking container, is seated in the through-channel, and extends to the connector housing coupled to the sensor port on the external surface of the housing of the cooking system. The features on the connector housing interact with complementary features on the housing of the cooking system to prevent rotation of the connector housing relative to the housing of the cooking system.

In some embodiments, rotation of the connector housing can be prevented along a first axis and along a second axis extending substantially perpendicular to the first axis.

The method of cooking can have a variety of configurations for various cooking operations. In some embodiments, the method can further comprise inserting a second cooking container having a second internal volume into a second internal compartment in the housing of the cooking system. In other embodiments, the method can further comprise instructing the cooking system to perform at least one cooking operation, and wherein in response the cooking system activates at least one heating element disposed within the housing. In certain embodiments, the method can further comprise activating the cooking system to perform a cooking operation, and wherein the cooking system includes a heating element that is controlled in response to an input measured by the probe.

DESCRIPTION OF DRAWINGS

These and other features will be more readily understood from the following detailed description taken in conjunction with the accompanying drawings, in which.

Figure 1:
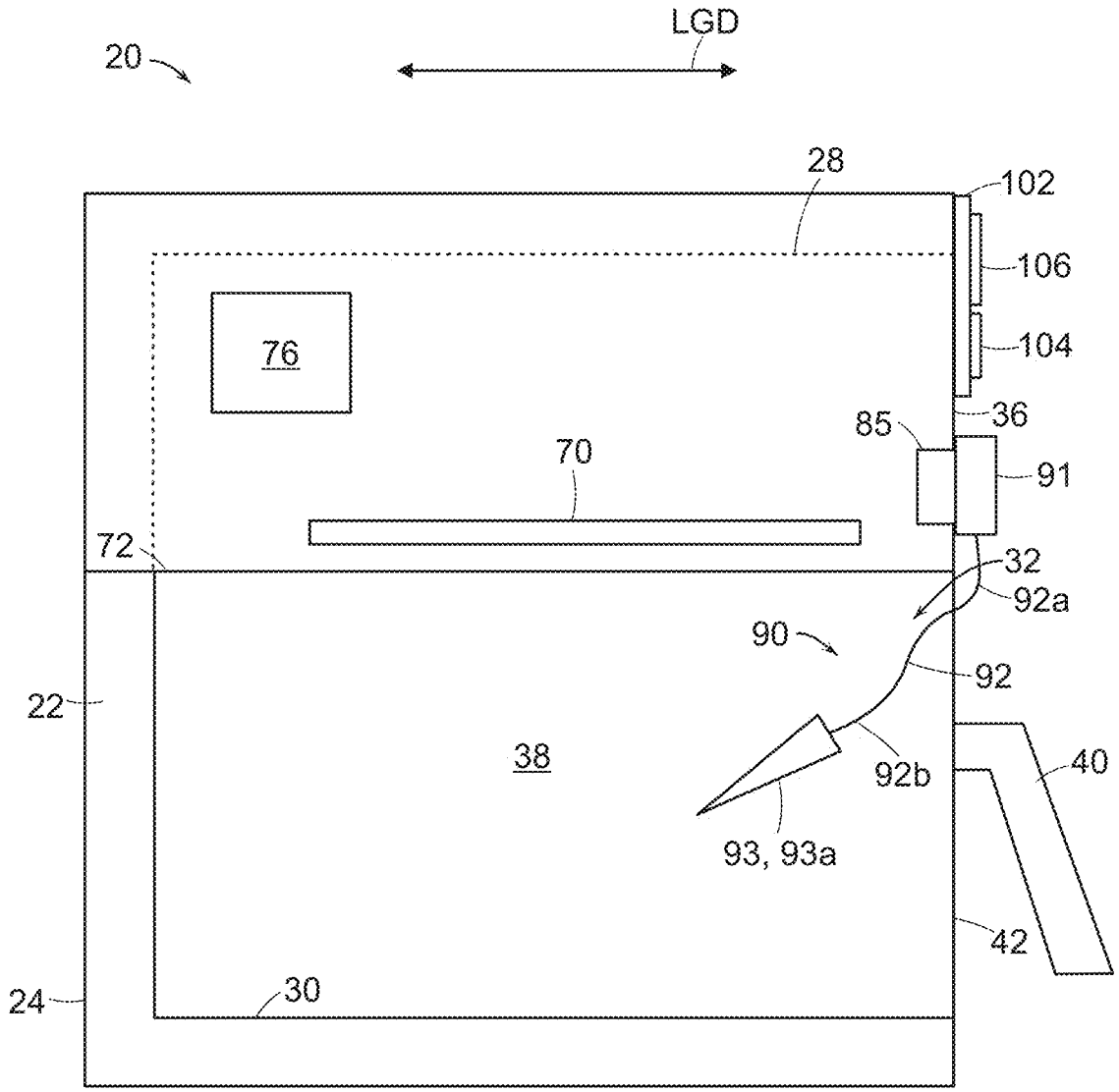
FIG. 1 is a schematic diagram of one embodiment of a cooking system having a cooking container removably disposed therein and having a temperature probe coupled thereof.

It is noted that the drawings are not necessarily to scale. The drawings are intended to depict only typical aspects of the subject matter disclosed herein, and therefore should not be considered as limiting the scope of the disclosure.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

In general, a cooking system is provided that includes a temperature probe that can extend into an internal cooking volume in order to determine a temperature of the cooking volume or a food product arranged within the cooking volume. The cooking system generally includes a housing, at least one cooking container, and a sensor assembly. The housing can have at least one internal compartment configured to receive the at least one cooking container, at least one heating element disposed in the housing for heating an internal volume of the at least one container, and a sensor port arranged on an exterior surface of the housing. The housing can also optionally include at least one air movement device for circulating air through the housing and/or at least one cooking container. The at least one cooking container is receivable within the at least one internal compartment of the housing, and it includes a through-passage extending therethrough. The sensor assembly can include a connector housing configured to be arranged within the sensor port, a cable extending from the sensor housing and configured to pass through the through-passage in the container, and a probe arranged at a distal end thereof. The through passage can be arranged to allow the electrical connection of the temperature probe to be positioned outside of the cooking volume such that only the durable cable and probe are subject to the heat and air movement within the cooking volume. By using the sensor assembly, the cooking device can automatically control the heating elements and/or the air movement devices arranged therein.

Furthermore, in order to prevent damage to the connector housing and sensor port when the first cooking container is inserted and removed from the housing with the temperature probe arranged therein, the connector housing can include a first projection extending into a channel of the exterior surface of the housing. The first projection can be configured to prevent lateral rotation of the connector housing when arranged within the sensor port. The connector housing can also include a second projection extending downwardly from the sensor port to the through-passage. The second projection can be configured to align the cable with the through-passage when the connector housing is arranged within the sensor port. In some embodiments, the second projection can include an interior surface configured to contact an exterior surface of the connector housing when the connector housing is arranged within the sensor port. The second projection can thus be configured to prevent longitudinal rotation of the connector housing when arranged within the sensor port. The combination of both the first and second projections can therefore help prevent lateral and longitudinal rotation of the connector housing, preventing additional stress and strain from being placed on the electrical projection plugged into the sensor port.

Figure 2:
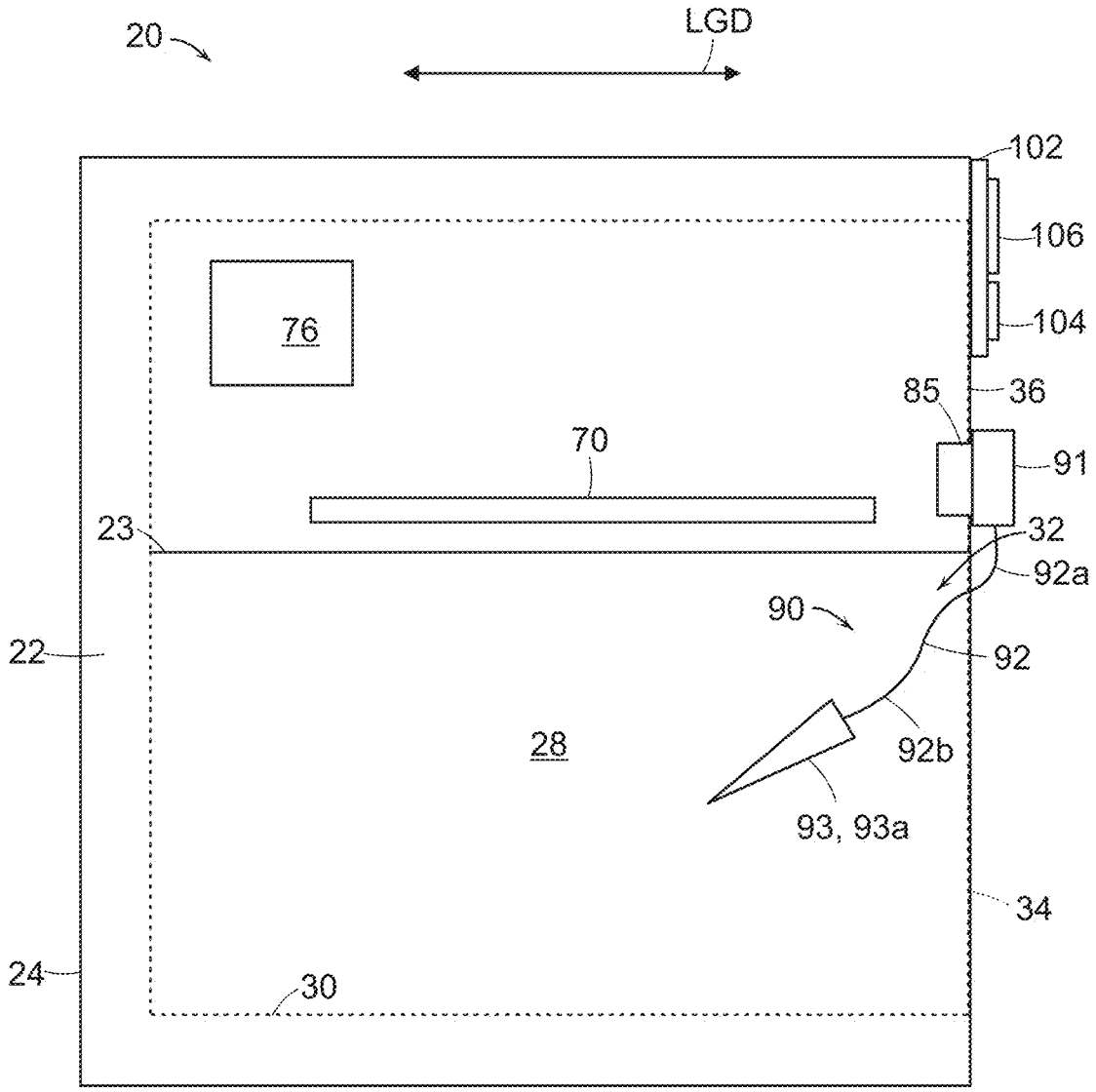
FIG. 2 is a schematic diagram of the cooking system of FIG. 1 with the cooking container removed.

With reference now to FIGS. 1-6, an exemplary embodiment of a cooking system 20 is shown. The cooking system 20 includes a housing 22 having a generally cubic configuration with top and bottom surfaces, and four sides. The particular shape of the housing can vary and certain surfaces can be rounded or have other variations that alter the appearance of the housing. The exterior surface 24 of the housing can be formed from a heat resistant or non-conductive material such that the housing remains cool to touch. The housing can further include one or more interior compartments. In the illustrated embodiment, the housing has a first hollow compartment 28 arranged therein. An opening 34, shown in FIG. 2, is formed in an exterior surface 36 of the housing 22 for allowing a food container to be positioned within the compartment 28. A liner 30 can be disposed within at least a portion of the housing 22. The liner 30 can be formed from any suitable conductive material, such as aluminum. In an exemplary embodiment, the liner 30 defines the internal compartment 28 of the housing 22.

Additionally, the liner 30 can define an internal top surface 23 of the internal compartment. The top surface 23 can be spaced from the top surface of the housing 22 to allow other components to be disposed within the housing above the top surface 23 of the liner 30. It should be understood that other components of the cooking system 20, or surfaces thereof, may define the internal compartment 28.

As further shown in FIGS. 1-6, a sensor port 85 can be arranged on a front exterior surface 36 of the housing 22. In an exemplary embodiment, the sensor port 85 is in the form of a blind bore formed in the exterior surface 36 of the housing 22 that is configured to receive a portion of a sensor assembly 90 therein. The sensor port 85 can include an electrical connector, such as a jack port 87 shown in FIGS. 4 and 6, that is arranged within the sensor port 85 and that interfaces with the sensor assembly 90, explained in further detail below. The jack port 87 can be configured to create an electrical communication between the sensor assembly 90 and an internal control system. The sensor port 85 can also include a channel 88 offset from the jack port 87 and extending further into the exterior surface 36 of the housing 22. The channel 88 can be configured to receive a projection on the sensor assembly 90, as discussed further below. Additionally, the channel 88 can be configured to extend around the jack port 87.

As indicated above, a cooking container 32 is removably receivable within the internal compartment 28 of the housing 22. Although the cooking container 32 is described herein as being separable from the housing 22, embodiments where the cooking container 32 is movably connected to the housing 22 are also contemplated herein. The cooking container 32 may be in the form of a pot or drawer, and it can be formed from various materials, such as a ceramic, metal, or die cast aluminum material. Any suitable material capable of withstanding the high temperatures required for cooking food products are also within the scope of the disclosure. In an exemplary embodiment, the cooking container 32 is configured to translate along an axis relative to the housing 22 in the longitudinal direction LGD such that the cooking container 32 is slidably received within the opening 34 formed in the front exterior surface 36 of the housing 22. In such embodiments, a size and shape of the cooking container 32 may be complementary to the size and shape of the opening 34 such that the cooking container 32 closes the opening 34 when disposed therein. In the illustrated embodiment, the cooking container 32 is generally cubic in shape. However, in other embodiments, the cooking container 32 may have another configuration.

As further shown, the cooking container 32 can have a generally hollow interior 38 for supporting one or more consumable products, such as food products for example, therein. Examples of food products suitable for use with the cooking system 20, include but are not limited to, meats, fish, poultry, bread, rice, grains, pasta, vegetables, fruits, and dairy products, among others.

As further shown in FIG. 1, at least one handle 40 may be associated with the cooking container 32 to allow a user to easily grasp and manipulate the cooking container 32 relative to the housing 22. In the illustrated embodiment, the cooking container 32 includes a single handle 40 extending from a front wall 42 of the cooking container 32. In other embodiments, the cooking container 32 may have two or more handles, or alternatively, a handle or groove can be formed in a surface of the cooking container 32. Any suitable configuration of the cooking container 32 and/or handle(s) 40 is within the scope of the disclosure.

Figure 4:
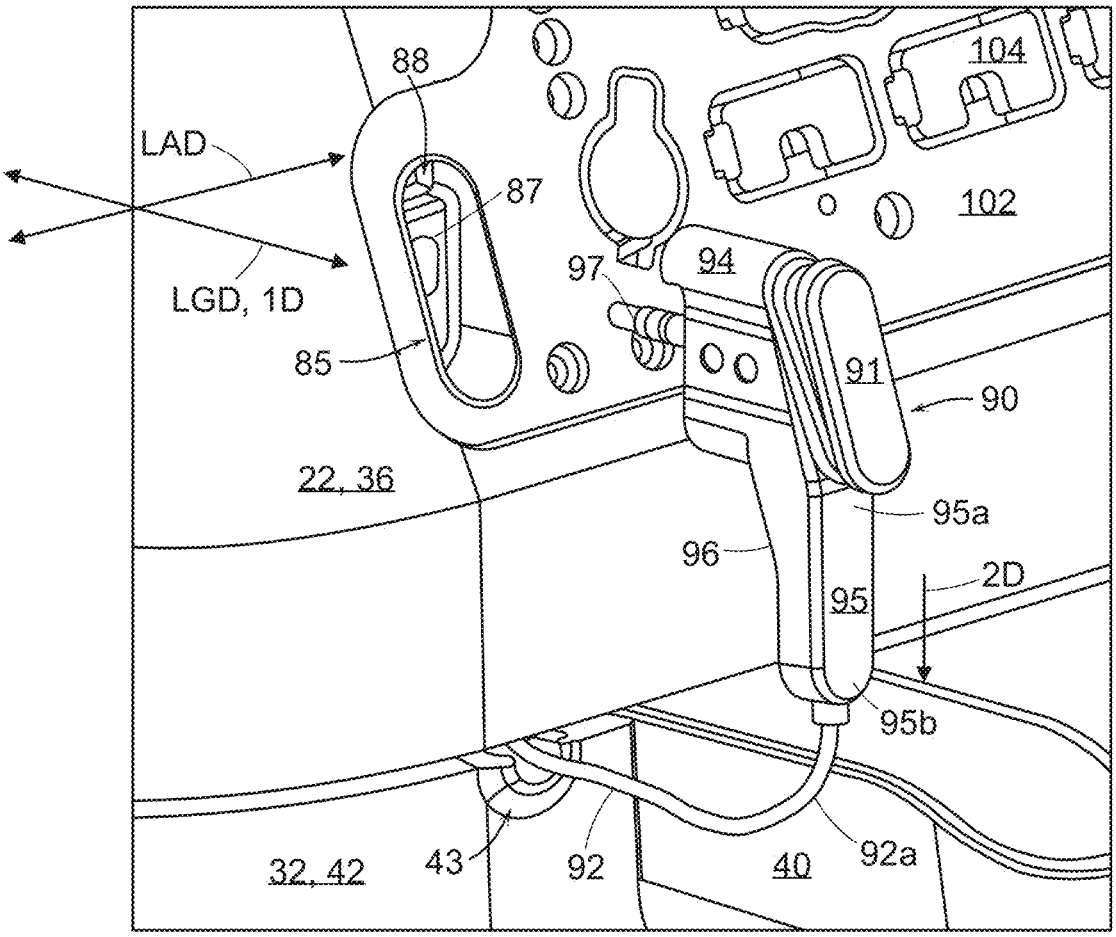
FIG. 4 is a perspective view of a portion of the cooking system of FIG. 1, with the temperature probe removed.
Figure 5:
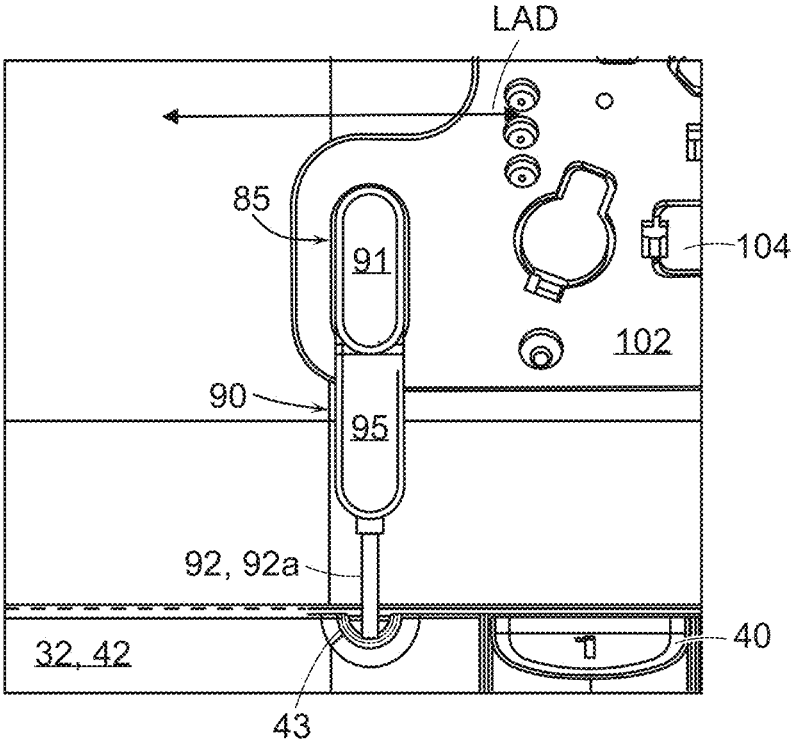
FIG. 5 is a detailed front view of a portion of the cooking system of FIG. 1, showing the temperature probe coupled thereto.

As further shown in FIGS. 4-5, the cooking container 32 can include a through-passage 43 arranged in the front wall 42 thereof. The through-passage 43 is configured to allow a cable of a sensor assembly to pass therethrough to allow a probe of the sensor assembly to be positioned within the cooking container 32. In the illustrated embodiment, the through-passage 43 is in the form of a semi-circular channel formed in a top surface of the cooking container 32, and that extends from the front wall 42 of the cooking container to an interior wall of the cooking container. When the cooking container is fully disposed within the housing, a front wall of the housing 22 defines an upper surface of the through-passage 43. The size of the through-passage 43 can vary, but preferably the through-passage 43 is sized to receive the cable while substantially limiting air flow therethrough such that heat is retained within the cooking volume of the cooking container.

Figure 6:
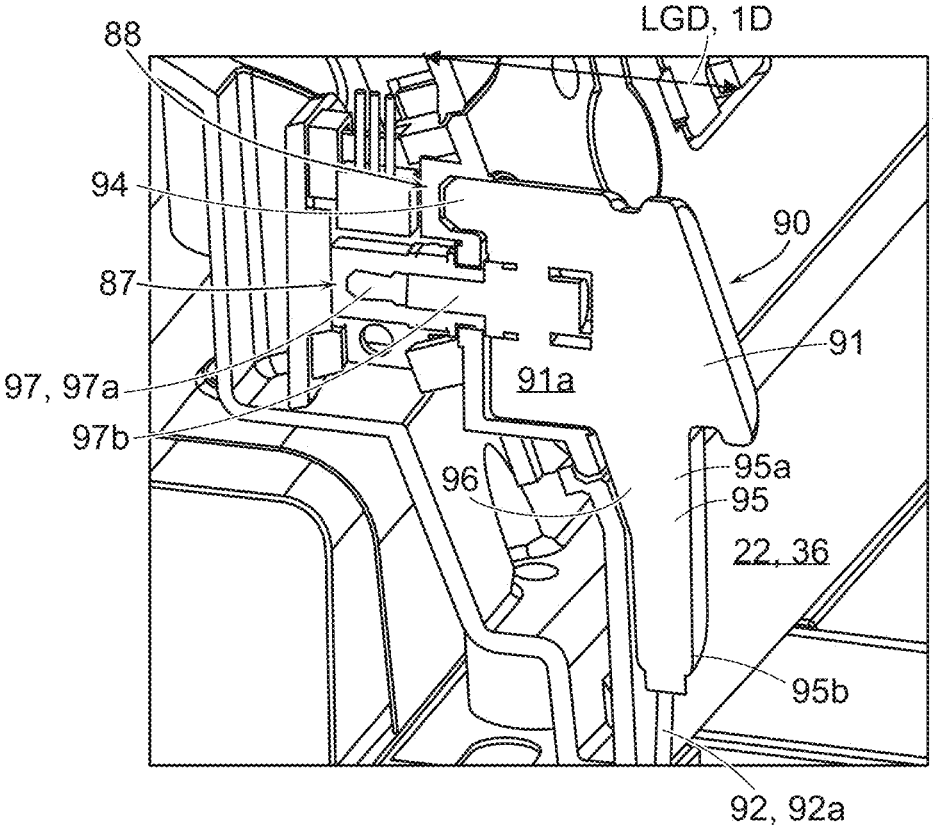
FIG. 6 is a cross-sectional view of a portion of the cooking system of FIG. 1, showing the temperature probe coupled therein.

As indicating above, the cooking system can further include a sensor assembly 90 arranged on the exterior surface 36 of the housing 22. As shown in more detail in FIGS. 4-6, the sensor assembly 90 can include a connector housing 91, a cable 92, and a probe 93. The connector housing 91 can be configured to be removably disposed within the sensor port 85 in order to relay signals from the probe 93 to an internal control system 108. In an exemplary embodiment, the connector housing 91 is generally L-shaped with a main upper portion 91*a* and an extension or lower projecting portion 95 that extend generally perpendicular to one another. The L-shaped configuration can allow the connector housing 91 to be inserted into the sensor port 85 in the longitudinal direction LGD, while the extension or projecting portion 95 extends downward to align the cable 92 with the through-passage 43 when the connector housing 91 is inserted into the sensor port 85. As shown in FIG. 6, the upper portion 91*a* of the connector housing 91 can include an electrical pin 97 projecting from the housing that forms an electrical connection with the jack port 87. In an exemplary embodiment, the electrical pin 97 is generally cylindrical-shaped with a cylindrical body 97*a* and tapered tip 97*b* arranged on the cylindrical body 97*a*. The pin 97 cab extend generally perpendicular to the extension or lower projecting portion 95. The electrical pin 97 can have a length that is greater the length of a projection 94. The cylindrical and tapered design can allow the electrical pin 97 to be inserted into a jack port 87 in the longitudinal direction LGD. In some embodiments, the electrical pin 97 is a DC adapter jack which corresponds to the jack port 87 of the sensor port 85. The cable 92 can be coupled to the electrical pin 97 and it can extend from the pin through the projecting portion 95 of the housing where it exits the housing at the distal end thereof.

As further shown in FIGS. 4 and 6, the connector housing 91 can also include a projection 94 extending from the connector housing 91 and configured to extend into the channel 88 of the exterior surface 36 of the housing 22. The projection 94 can extend generally parallel to the electrical pin 97. When the connector housing 91 is arranged within the sensor port 85, the projection 94 is configured to prevent rotation of the connector housing 91.

Also as shown in FIGS. 4 and 6, the main upper housing and lower projecting portion 95 of the connector housing can have an interior surface 96 that is shaped to match a contour of the exterior surface 36 of the housing 22. For example, the interior surface 96 can include a first and second planar portions positioned at an angle relative to one another to match the contour of the exterior surface 36 of the housing 22. This can also aid in preventing rotation of the connector housing 91 relative to the housing 22. Accordingly, the projection 94 and the lower projecting portion 95 can help prevent damage to the electrical pin 97 extending from the connector housing 91. In particular, the stress and strain placed on the electrical projection 97 can be reduced during insertion and removal of the cooking container 32.

A person skilled in the art will appreciate that the connector housing and pin can be formed from various materials. In an exemplary embodiment, the pin can be formed from an electrically conductive material such as steel, aluminum, or iron, and the connector housing 91 is formed from a non-conductive material such as plastic or rubber.

As indicated above, the cable 92 extends from the connector housing 91. In particular, the cable 92 can have a proximal end 92*a* connected to the electrical pin 97 in the connector housing, and a distal end 92*b* connected to a probe 93. The cable 92 is thus configured to transmit a signal from the probe 93 to the electrical pin 97 in the connector housing 91. The cable 92 can be configured to pass through the through-passage 43 in the cooking container 32.

Figure 3:
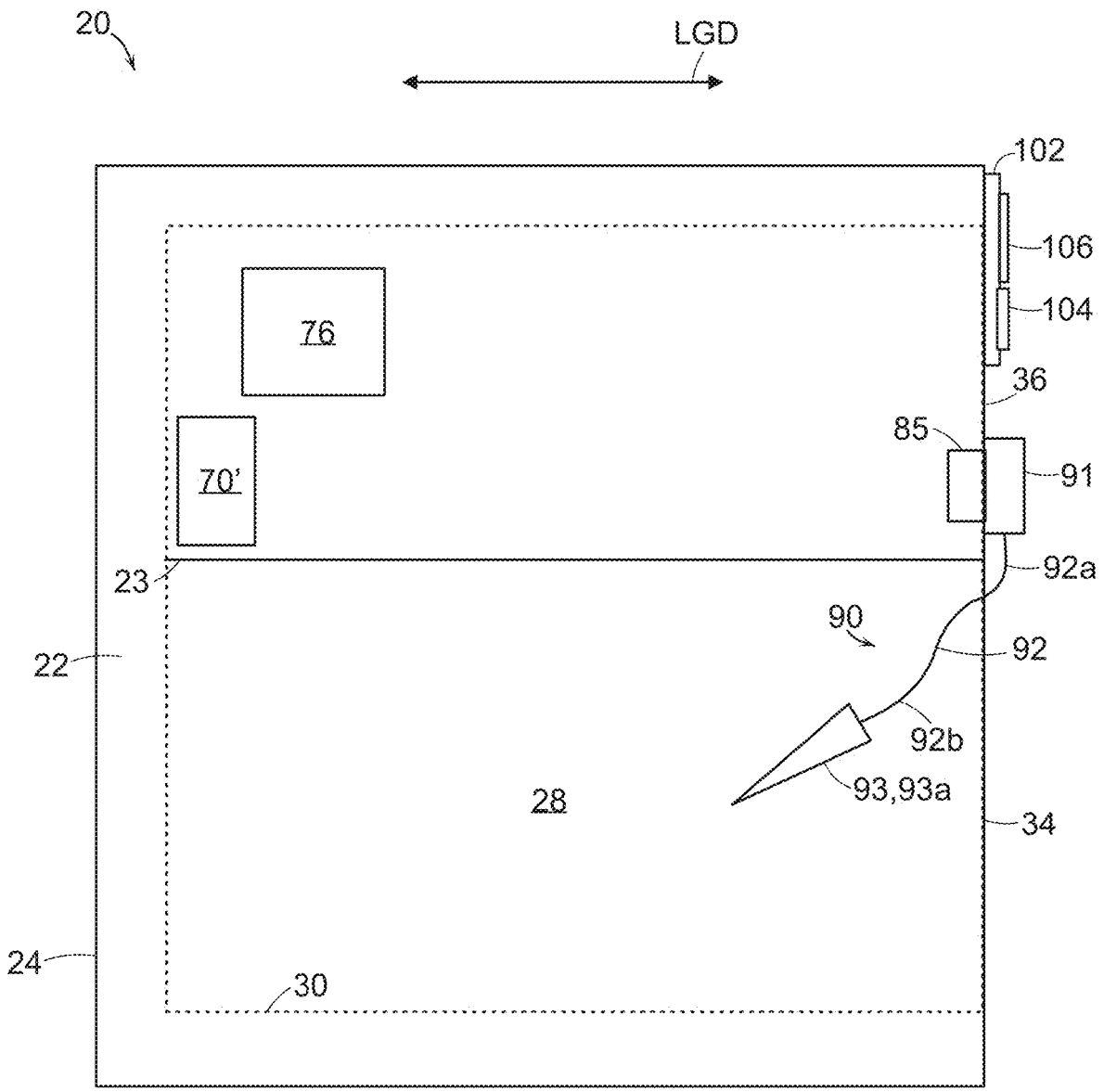
FIG. 3 is a schematic diagram of the cooking system of FIG. 1 with the cooking container removed.

As shown in FIGS. 1-3, the probe 93 arranged at the distal end 92*b* of the cable 92 is configured to measure the temperature of the cooking volume within the interior of the cooking container 32. In some embodiments, the probe 93 is a temperature sensor having a body 93*a* which can be directly inserted into food products. Additionally, if a food product being place within the cooking container 32 is not large enough or too numerous to have the probe 93 inserted therein (e.g., a pile of french fries), the probe 93 can be placed within the cooking container 32 within a close proximity to or within the pile of the food product placed in the cooking container 32 in order to determine the temperature of food product which cannot have the probe 93 inserted therein.

As indicated above, the cooking system 20 can include a number of additional components to aid in operation of the device. In an exemplary embodiment, the cooking system 20 includes at least one heating element 70 operable to impart heat to the cooking volume during one or more modes of operation of the cooking system 20. As shown in FIGS. 1-2, the heating element 70 is positioned within the housing at a location above the internal compartment 28, generally at or above an upper extent or surface 72 of the cooking container 32, such as proximate a center of the cooking container 32 for example. In an exemplary embodiment, the heating element 70 is disposed adjacent a center of the cooking volume and/or the cooking container 32 and is mounted completely outside of the cooking container 32 such that it is vertically offset from the upper extent or surface 72 thereof. As shown in FIG. 3, at least one heating element 70' may be located adjacent the rear of the internal compartment 28. However, it should be understood that a heating elements 70, 70' can be located at any suitable location is within the scope of the disclosure.

As indicated above, the at least one heating element 70 may be capable of performing any suitable type of heat generation. For example, a heating element 70 configured to heat one or more food items located within the cooking volume of the cooking container 32 via conduction, convection, radiation, and induction are all within the scope of the disclosure. In the illustrated embodiment, the heating element 70 is a convective heating element, and the cooking system 20 additionally includes an air movement mechanism 76, such as a fan, operable to circulate air through the cooking volume. The air is heated as it flows along a path of circulation, such as by flowing over a portion of the at least one heating element 70. As shown, the air movement mechanism 76 is located within the internal compartment 28 at a position entirely above the upper extent 72 of the cooking container 32. In addition, at least a portion of the air movement mechanism 76, and in some embodiments the entirety of the air movement mechanism 76, is disposed vertically above the cooking volume. As shown, the air movement mechanism 76 can be horizontally offset from the at least one heating element 70. However, embodiments where the air movement mechanism 76 vertically or horizontally overlaps or is aligned with the at least one heating element 70 are also contemplated herein.

The air movement mechanism 76 can be driven by a motor located at least partially external to the internal compartment 28. The cooking system 20 can also include at least one additional air movement mechanism for cooling the motor. One or more vents (not shown) can be provided for exhausting hot air generated by operation of the at least one of the air movement mechanism 76 or the motor to the exterior of the cooking system 20.

In an exemplary embodiment, the air movement mechanism 76 of the cooking system 20 is a variable speed fan operable at a plurality of rotational speeds. In one embodiment, the operational speed of the air movement mechanism 76 can vary based on the cooking mode selected. For example, the speed of the air movement mechanism 76 during operation in a first cooking mode may be different than the speed of the air movement mechanism 76 during operation in a second cooking mode. The operational speed of the air movement mechanism 76 may be controlled by a processor 110 in response to one or more inputs 104, including selection of a cooking mode. However, the processor 110 can also be configured to adjust the operational speed of the air movement mechanism 76, or alternatively, the power supplied to the heating element(s) 70 to control the temperature and/or pressure within the internal compartment 28 of the cooking container 32.

Figure 7:
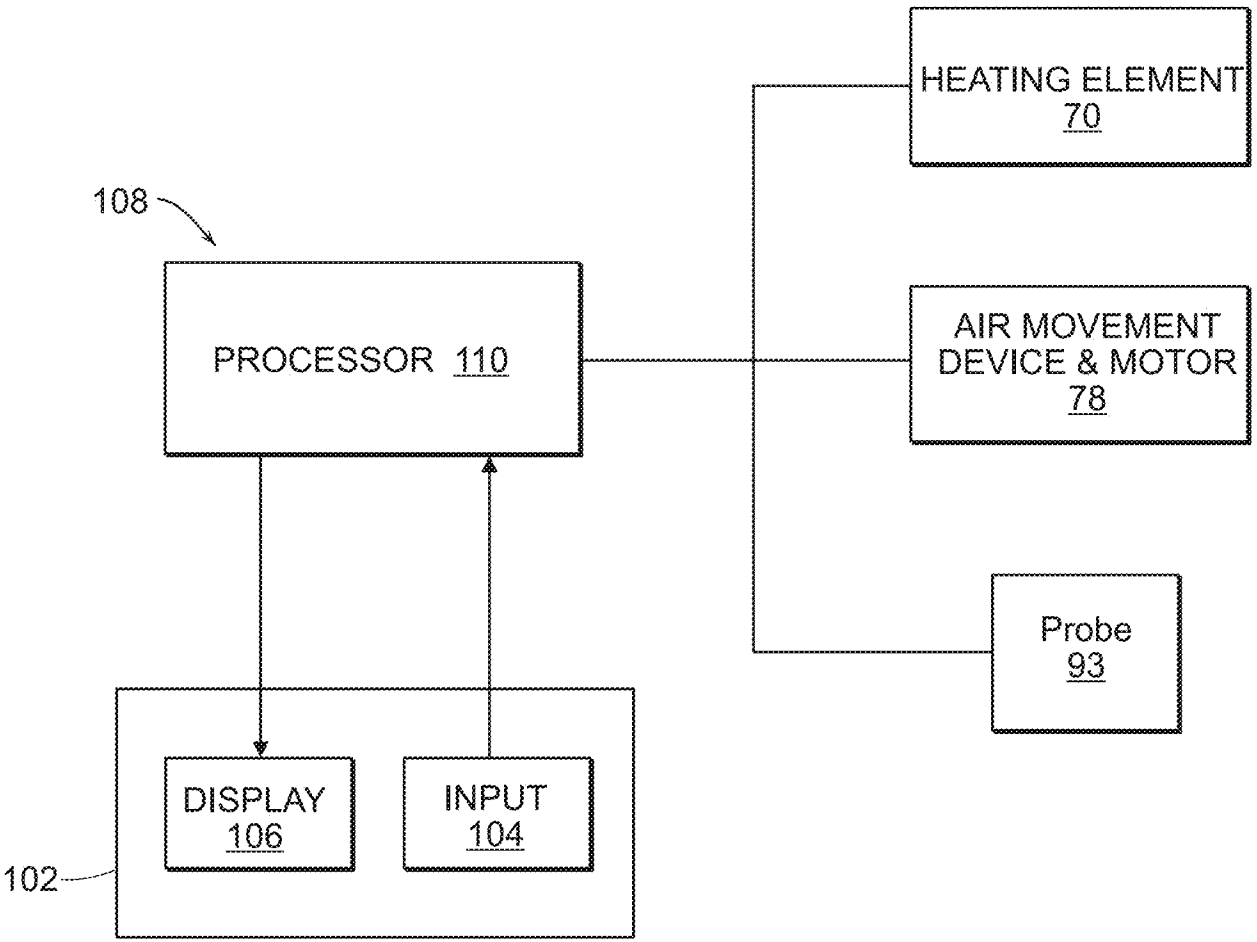
FIG. 7 is a schematic diagram of one embodiment of a control system for use with a cooking system.

Turning to FIG. 7, the cooking system can further include a control panel or user interface 102 positioned on the exterior surface of the housing 22. The control panel 102 can include one or more inputs 104 associated with energizing the heating element 70 of the cooking system 20 and for selecting various modes of operation of the cooking system 20. One or more of the inputs 104 can include a light or other indicator to show that the respective input has been selected. The control panel 102 can additionally include a display 106 separate from and associated with the at least one input 104. However, embodiments where the display 106 is integrated into the at least one input 104 are also contemplated herein.

In one embodiment, at least one input 104 on the control panel 102 is an on/off button which allows the user to activate or deactivate the control panel 102. When the control panel 102 is deactivated, the one or more heating elements 70 are not energized and the entire cooking system is turned off. In an exemplary embodiment, the at least one input 104 is operable to select one or more manual modes of operation of the heating element 70, e.g., allowing the user to control the temperature and/or time of a cooking operation. For example, a user may be able to enter a time associated with operation of the cooking system 20 in a manual mode. The time may be entered via the same input 104 or a separate input 104 as used to select a mode of operation. Alternatively, or in addition, at least one input 104 is operable to select a stored sequence of operation. In some cases, the stored sequences may be particularly well suited for a given method of food preparation and/or for particular ingredients or types of ingredients. The plurality of stored sequences associated with the at least one input 104 may be stored within a memory accessible by the processor 110. Alternatively, the plurality of stored sequences may be stored remotely from the cooking system 20, and may be accessed by the processor 110, such as via wireless communication. The display 106 can also be configured to indicate a time remaining during any cooking operation. Temperature or other parameters may also be entered via inputs 104 and/or shown on the display 106.

The at least one input 104 may include a distinct start button intended to initiate operation in a desired mode, a distinct stop button to cease all operation, or a stop/start button intended to initiate and cease functions. The cooking system 20 can also or alternatively be operable to automatically start operation after a predetermined time has elapsed once an input 104 has been selected and any necessary information has been provided to the control panel 102. Alternatively or in addition, one or more of the other inputs 104 may be operable to start and stop operation of the cooking system 20, regardless of whether the cooking system 20 is following a stored sequence or is in a manual mode.

As previously noted, the one or more inputs 104 may be operable to initiate operation of the cooking system 20 in a plurality of cooking modes. In one embodiment, the cooking system 20 is operable in a cooking mode where the heating element 70 is employed to perform a non-contact heating operation, such as a convective or radiative heating operation. Suitable cooking operations that may be performed in this first cooking mode include, but are not limited to, air frying, broiling, baking/roasting, and dehydrating.

FIG. 7 illustrates an exemplary embodiment of a control system 108 of the cooking system 20 of FIG. 1, including a controller or the processor 110 for controlling operation of the heating element 70 and air movement mechanism 76 (including the motor associated therewith), and in some embodiments for executing stored sequences of a cooking operation. The processor 110 is operably coupled to the control panel 102, the heating element 70, the air movement mechanism 76, and optionally the probe 93.

Operation of the cooking system 20, and in particular of the one or more heating elements 70 and air movement mechanism 76, may be regulated in response to the parameters sensed by the probe 93. In one embodiment, the probe 93 includes a temperature sensor arranged in communication with the processor 110. In an exemplary embodiment, the probe 93 is a negative temperature coefficient (NTC) sensor for example. In embodiments of the cooking system 20 including the probe 93 as a temperature sensor, adjustment of an operating parameter, such as operation of the heating element 70 for example, may be performed using the control algorithm in response to the temperature measured by the probe 93 within the cooking container 32. For example, power provided to the heating element 70 may be increased if the sensed temperature is below a set point, and the power provided to the heating element 70 may be reduced or ceased completely if the sensed temperature is above a set point, thereby allowing the cooking volume to cool.

While FIG. 1 illustrates an embodiment of a cooking system 20 having an internal compartment configured to receive a single removable food container, the cooking system 20 can include multiple internal compartments with multiple removable food containers. FIGS. 8-11 illustrate another embodiment of a cooking system 120 having similar components to cooking system 20 as described above. Therefore, like components will not be described in detail. In this embodiment, the cooking system 120 includes a housing 122 having a first internal compartment 128*a* and a second internal compartment 128*b* that are separated from one another at least in part by a divider or wall 130. The divider 130 is positioned about a mid-portion of the housing and extends vertically from a base of the housing to define a sidewall of two adjacent internal compartments 128*a*, 128*b*. As further shown, the cooking system 120 include an upper internal compartment 128*c* containing respective heating elements 170*a*, 170*b* and air movement mechanisms 176*a*, 176*b* therein. As shown, all three internal compartments 128*a*, 128*b*, 128*c* are fluidly separate from one another.

Each of the internal compartments 128*a*, 128*b* formed in the housing 122 may be substantially identical to the internal compartment 28 previously described with respect to FIGS. 1-6. More specifically, a respective cooking container 132*a*, 132*b* is removably insertable into each internal compartment 128*a*, 128*b*. An insert can optionally be removably installed within the interior 138*a*, 138*b* of each cooking container 132*a*, 132*b*. In addition, as indicated above, each internal compartment 128*a*, 128*b* is positioned below at least one heating element 170*a*, 170*b* and an air movement mechanism 176*a*, 176*b* configured to circulate air through the internal compartment 128*a*, 128*b*, respectively. The components associated with operation of each internal compartment, such as the heating element and air movement mechanism, can be independently operable and fluidly separate from the components of the adjacent internal compartment.

In the embodiment of FIGS. 8-11, each air movement mechanism 176*a*, 176*b* is illustrated as a fan wheel or impeller 182*a*, 182*b* that is configured to rotate about a generally vertically oriented axis. As shown, the air movement mechanisms 176*a*, 176*b* include electric motors 178*a*, 178*b*, and can be stacked vertically relative to the heating element 170*a*, 170*b* such that a flow of air is configured to be drawn from the heating element 170*a*, 170*b* through the air movement mechanism 176*a*, 176*b* sequentially. The axial flow of air provided to the inlet of the air movement mechanism 176*a*, 176*b* is expelled from the impeller 182*a*, 182*b* radially, adjacent the sides of the internal compartment 128.

Figure 8:
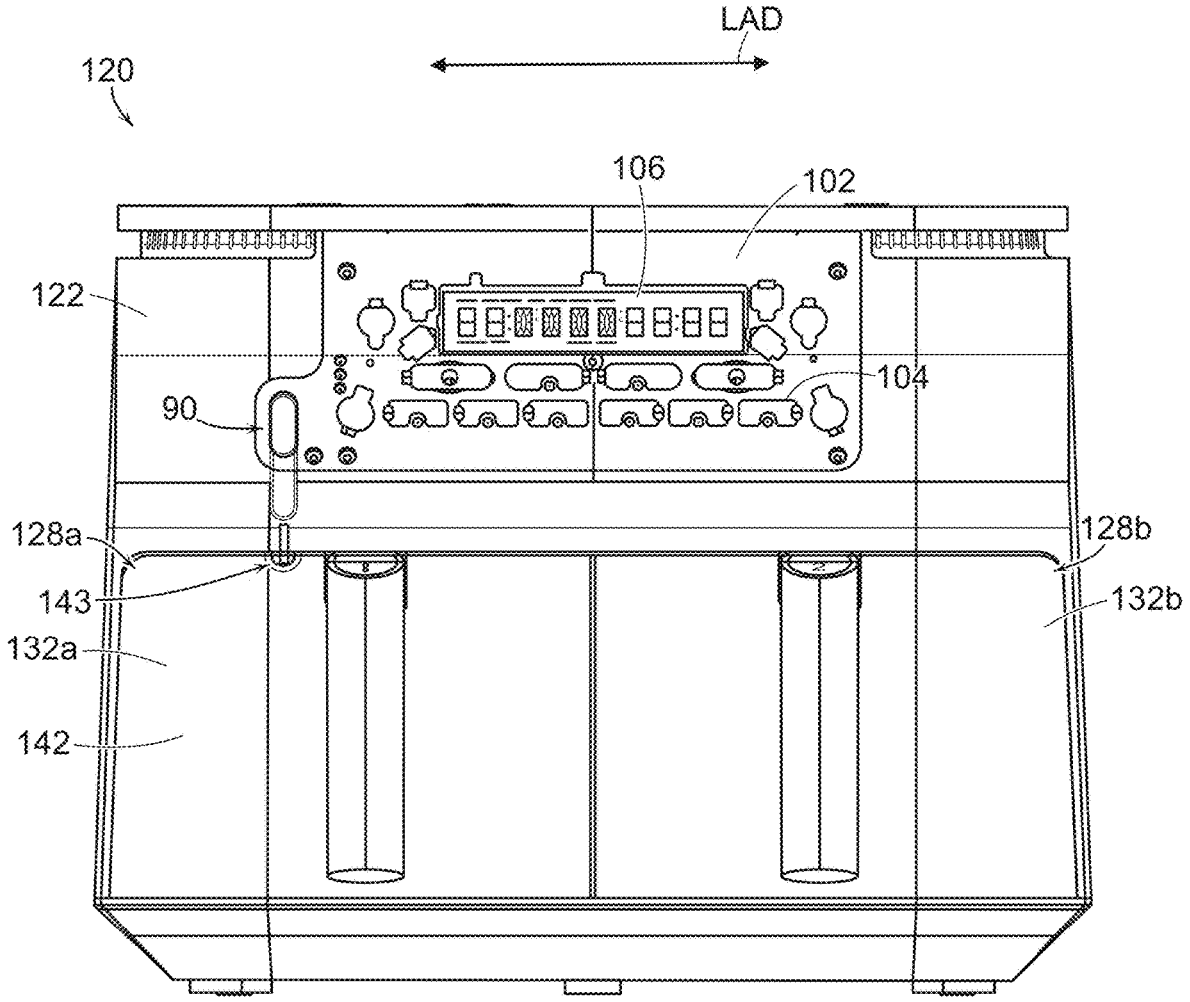
FIG. 8 is a front view of another embodiment of a cooking system having two cooking containers.
Figure 9:
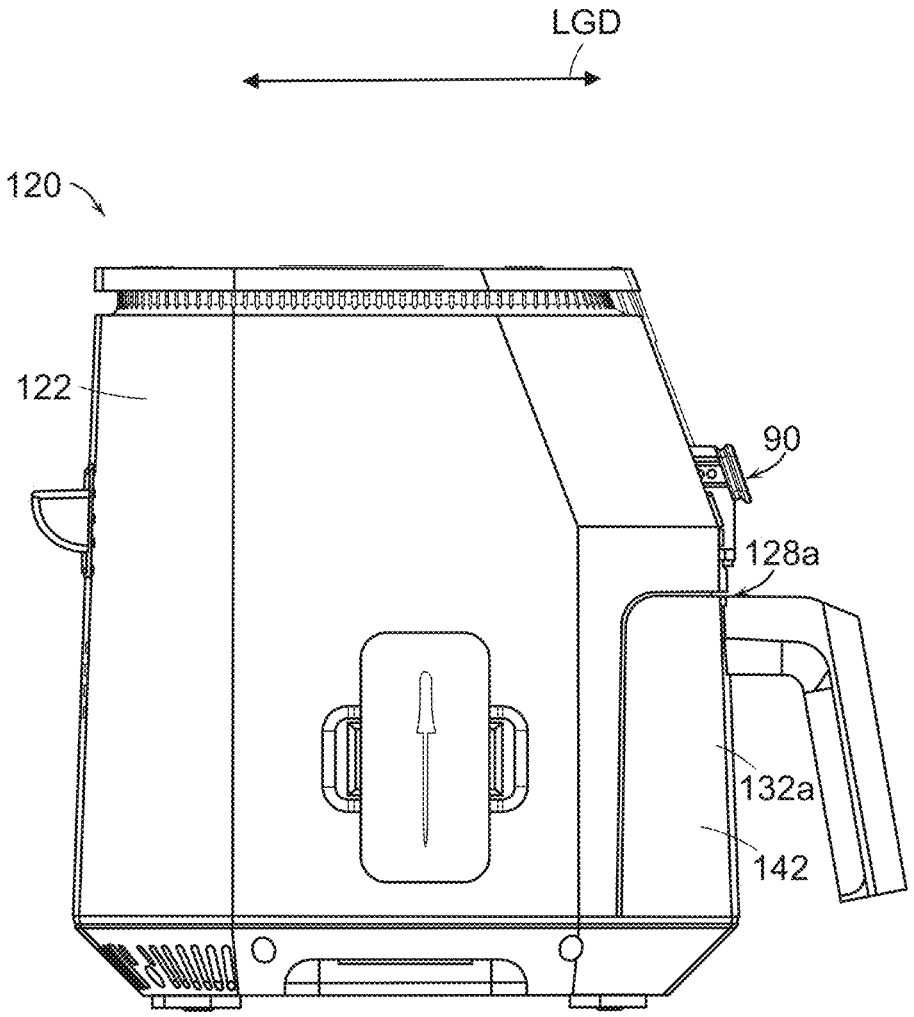
FIG. 9 is a side view of the cooking system of FIG. 8.
Figure 10:
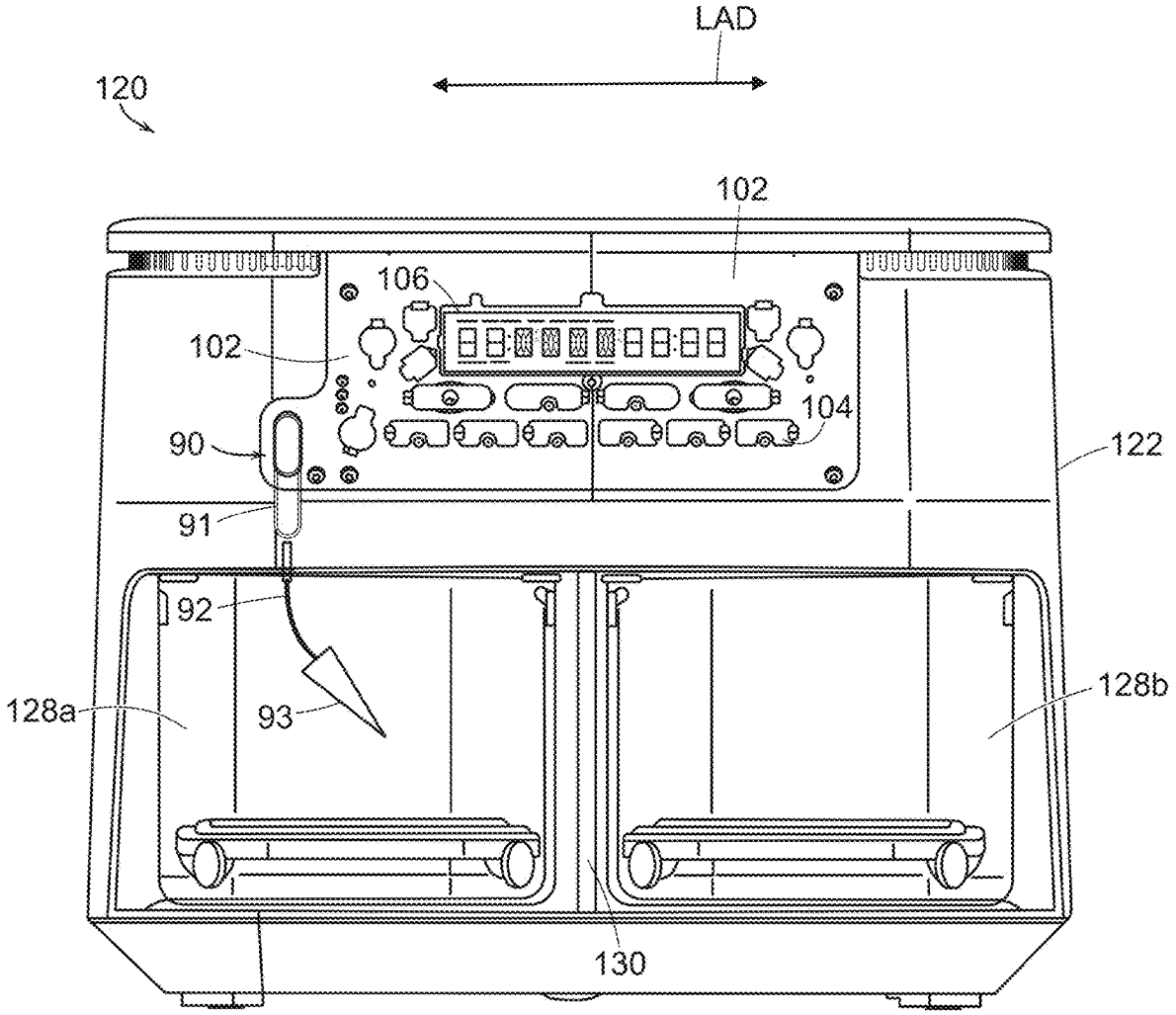
FIG. 10 is a front view of the cooking system of FIG. 8, with the cooking containers removed.
Figure 11:
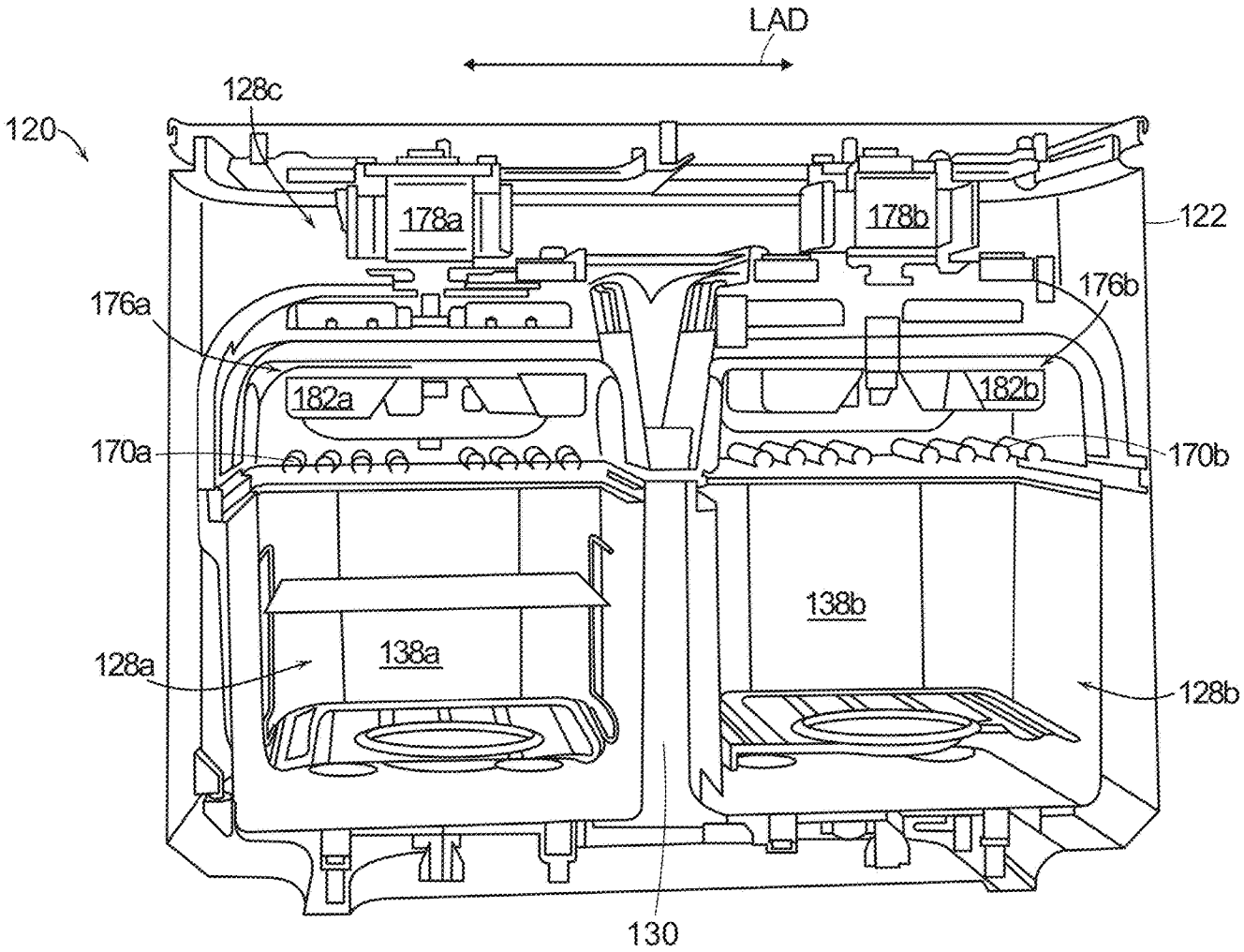
FIG. 11 is a perspective cross-sectional view of the cooking system of FIG. 8.

As further illustrated in FIG. 8, the sensor assembly 90 of FIGS. 1-6 is arranged on the cooking system 120. While only one sensor assembly 90 is shown, the cooking system 120 can include two sensor assemblies 90 for use in each of the internal compartments 128*a*, 128*b*. As further shown, similar to the prior embodiment, the cooking assembly of FIGS. 8-11 can also include a through-passage 143 formed therein for allow a cable of the sensor assembly 90 to pass therethrough.

Figure 12:
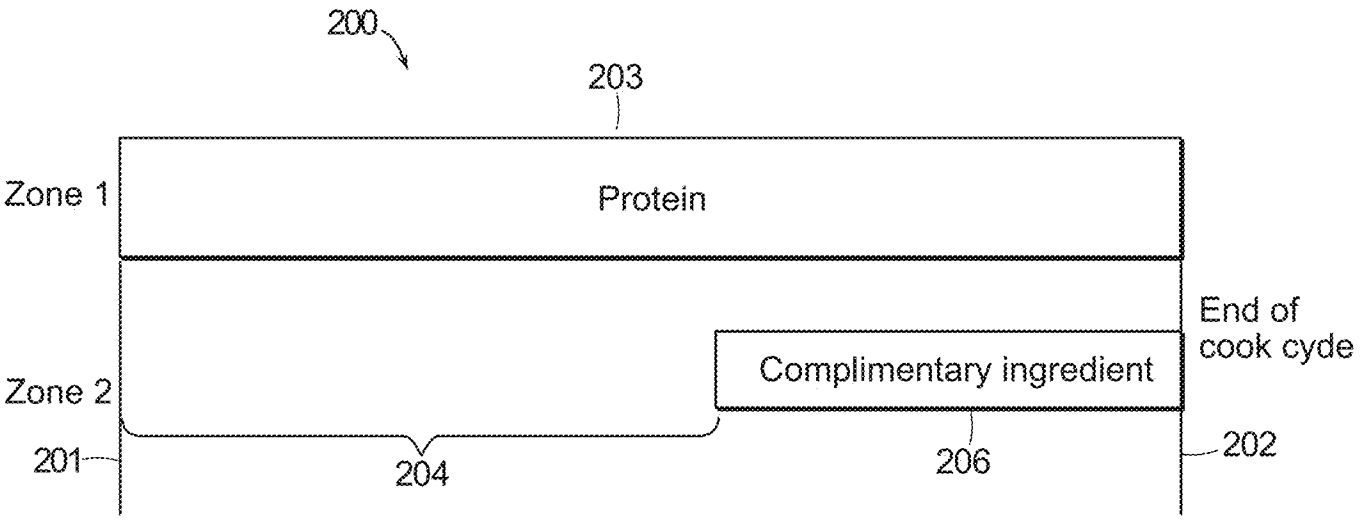
FIG. 12 is a graph depicting the cooking sequences of the cooking system of FIG. 8.

Since both cooking containers 132*a*, 132*b* are fluidly separate from one another, the sensor assembly 90 can be used to perform two different cooking operations with the cooking system 120 so that the food product placed in both cooking containers finishes at the same time. An example of separate cooking processes is illustrated in FIG. 12. Graph 200 is a schematic view of multiple cooking operations occurring at the same time. "Zone 1" is the cooking volume of cooking container 132*a*, where the probe 93 is positioned, and "Zone 2" is the cooking volume of cooking container 132*b*. The cooking system 120 is arranged such that the food product within cooking container 132*a* requires a longer cooking time than the food product placed in cooking container 132*b*. For example, a protein can be arranged in cooking container 132*a*, and vegetables can be placed in cooking container 132*b*. Line 201 represents the start point for the cooking operation in the cooking container 132*a*. Block 203 represents the cooking time in Zone 1, which extends from the start of the cooking operation, represented by line 201, to the end of the cooking operation, represented by line 202. Timeframe 204 represents the time when the heating element 170*b* arranged above cooking container 132*b* is not active since the food product in cooking container 132*b* requires a shortened cooking time compared to cooking container 132*a*. Since the probe 93 is inserted into cooking container 132*a*, the cooking system 120 can detect the point in time to activate the heating element 170*b* in Zone 2 to begin the cooking operation, represented by block 206. The cooking system 120 can determine the remaining cooking time of the food product in Zone 1, and activate the cooking operation in Zone 2 when the food product in Zone 1 reaches a threshold value, such that both Zone 1 and Zone 2 will finish their cooking operations simultaneously.

Figure 13:
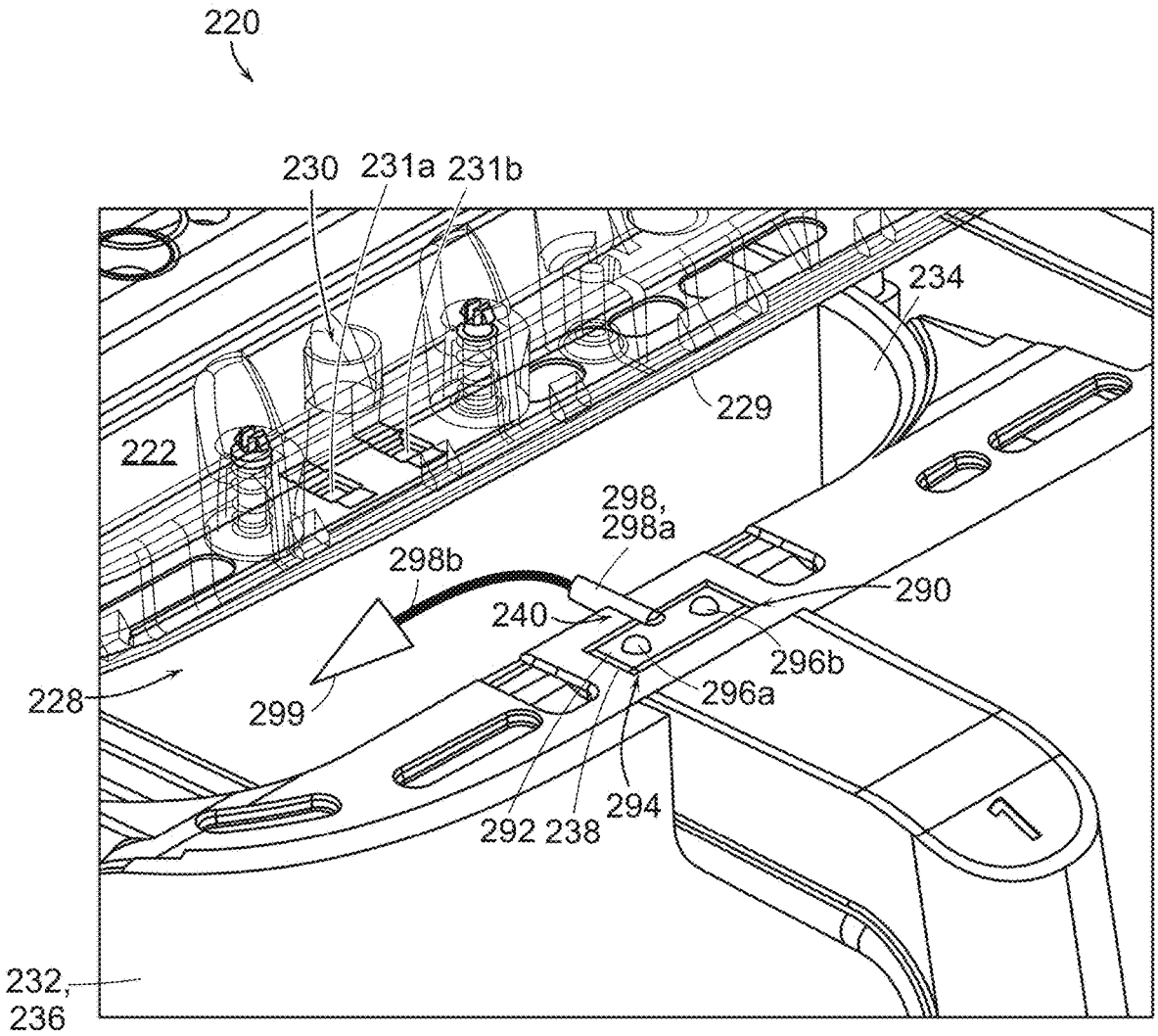
FIG. 13 is a perspective view of a portion of another embodiment of a cooking system.

FIG. 13 illustrates another embodiment of a cooking system 220. Cooking system 220 contains similar components to cooking system 20 and cooking system 120 as described above. Therefore, like components will not be described in detail. The illustrated cooking system 220 includes a housing 222 having an internal compartment 228 that is substantially identical to internal compartment 28 previously described with respect to FIGS. 1-6. A cooking container 232 is removably insertable into the internal compartment 228, and an insert may be removably installed within the interior of the cooking container 232. While not shown, the cooking system can include at least one heating element and at least one air movement mechanism configured to circulate air through the internal compartment 228.

As indicated above, has the cooking container 232, which is removable from the internal compartment 228. The cooking container 232 includes an inner container 234, where a first cooking volume is defined within the inner container 234. An outer wall 236 is arranged about the inner container 234, creating a space between the inner container 234 and the outer wall 236. A channel 238 is arranged between the inner container 234 and the outer wall 236 which extends parallel to a front face of the cooking container 232. As will be described below, a through-passage 240 is arranged to extend from the channel 238 to the cooking volume defined by the inner container 234 through the inner container 234 to allow for passage of a wire of a temperature probe arranged within the cooking container 232.

Similar to the jack port 87 for the cooking system 20, the cooking system 220 has an electrical connector arranged within the housing 222 to selectively couple a temperature probe to a control unit of the cooking system 220. Instead of being arranged on an exterior surface of the housing, a first electrical connector 230 is formed in an internal top surface 229 of the internal compartment 228. In particular, the first electrical connector 230 is positioned within a recess (not shown) within the internal top surface 229. The first electrical connector 230 can include prongs 231*a*, 231*b* which extend downward into the internal compartment 228 from the internal top surface 229. The recess is arranged on an edge of the internal top surface 229 and extends parallel to a front outer face of the housing 222. The first electrical connector 230 is communicatively coupled to a control system within the cooking system 220, and selectively couples a probe to the control system via the prongs 231*a*, 231*b* when the cooking container 232 is inserted into the internal compartment 228.

A corresponding sensor assembly 290 can be arranged within the cooking system 220. In an exemplary embodiment, the sensor assembly 290 includes a connector housing 292 positioned within the channel 238 between the inner container 234 and the outer wall 236, and a second electrical connector 294 positioned within the connector housing 292. The connector housing 292 may be removably positioned within the channel 238 in order to allow full removable of the connector housing 292. With the connector housing 292 removed, the connector housing 292 can be cleaned or the cooking system 220 can be used without the sensor assembly 290.

The second electrical connector 294 includes prongs 296*a*, 296*b* extending upward from the connector housing 292 such that they extend above the top surface of the cooking container 232. In an exemplary embodiment, the prongs 296*a*, 296*b* are spring-loaded pogo pins configured to move along a vertical axis. When the cooking container 232 is inserted within the internal compartment 228, the prongs 296*a*, 296*b* are pushed downward in order to allow the cooking container 232 to clear the housing 222. Once the prongs 296*a*, 296*b* clear the outer lip of the housing 222, the prongs 296*a*, 296*b* are spring-biased upward such that the prongs 231*a*, 231*b* of the first electrical connector 230 contact the prongs 296*a*, 296*b* of the second electrical connector 294. In an exemplary embodiment, both sets of the prongs 231*a*, 231*b* and prongs 296*a*, 296*b* can be spring-biased pogo pins, or a first set of prongs can be spring-biased pogo pins and the corresponding prongs are a stationary electrical contact. Even though the use of spring-biased pogo pins are described herein, any type of suitable electrical connectors that enable the described operation herein may be used to ensure connection between the probe and a control unit.

A cable 298 is connected to the connector housing 292 at a proximal end 298*a* of the cable 298. The cable 298 is configured to pass through the through-passage 240 in the inner container 234 to the cooking volume of the cooking container 232. In the illustrated embodiment, the through-passage 240 is in the form of a semi-circular channel formed in a top surface of the cooking container 232, and that extends from the channel 238 of the cooking container 232 to an interior wall of the inner container 234. Similar to the sensor assembly 90, a temperature probe 299 is arranged at a distal end 298*b* of the cable 298 and arranged within the cooking container 232.

Similar to the cooking system 20, operation of the cooking system 220, such as heating elements and air movement mechanisms, may be regulated in response to the parameters sensed by the probe 299. In one embodiment, the probe 299 includes a temperature sensor arranged in communication with a processor (not shown) arranged within the housing 222. In an exemplary embodiment, the probe 299 is a negative temperature coefficient (NTC) sensor. As the cooking system 220 is activated, the probe 299 will measure a signal corresponding to a temperature of the probe 299. This signal is passed through the cable 298 and to the prongs 296*a*, 296*b*. As stated above, when the cooking container is arranged within the housing, the spring-biased prongs 296*a*, 296*b* extend upward to contact the prongs 231*a*, 231*b*. With the prongs 296*a*, 296*b* contacting the prongs 231*a*, 231*b*, the signal measured by the probe 299 can be transmitted through the prongs 296*a*, 296*b* to the prongs 231*a*, 231*b*, which are communicatively coupled to a processor arranged within the housing 222.

Similar to the cooking system 120, the housing 222 can further include one or more interior compartments, each having a cooking container removably positioned therein. Additionally, while only one sensor assembly 290 is shown, the cooking system 220 can include two sensor assemblies for use in each of the internal compartments within the housing 222.

Certain exemplary implementations have been described to provide an overall understanding of the principles of the structure, function, manufacture, and use of the systems, devices, and methods disclosed herein. One or more examples of these implementations have been illustrated in the accompanying drawings. Those skilled in the art will understand that the systems, devices, and methods specifically described herein and illustrated in the accompanying drawings are non-limiting exemplary implementations and that the scope of the present invention is defined solely by the claims. The features illustrated or described in connection with one exemplary implementation may be combined with the features of other implementations. Such modifications and variations are intended to be included within the scope of the present invention. Further, in the present disclosure, like-named components of the implementations generally have similar features, and thus within a particular implementation each feature of each like-named component is not necessarily fully elaborated upon.

Approximating language, as used herein throughout the specification and claims, may be applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

One skilled in the art will appreciate further features and advantages of the invention based on the above-described implementations. Accordingly, the present application is not to be limited by what has been particularly shown and described, except as indicated by the appended claims. All publications and references cited herein are expressly incorporated by reference in their entirety.

What is claimed is:

1. A cooking system, comprising:

a housing having a front exterior surface and an internal compartment therein, at least one heating element configured to heat the internal compartment, and a sensor port arranged on an exterior of the housing; and a cooking container removably disposed within the internal compartment of the housing and defining an interior cooking volume, wherein the cooking container is removable through the front exterior surface of the housing;

a through-passage formed in at least one of the front exterior surface of the housing and a sidewall of the cooking container, the through-passage extending into the interior cooking volume of the cooking container; and a sensor assembly including a connector housing configured to operably mate to the sensor port, a cable extending from the connector housing and configured to pass through the through-passage and into the interior cooking volume, and a probe arranged at a distal end of the cable and configured to be positioned within the internal compartment for measuring a temperature therein.

2. The cooking system of claim 1, wherein the housing and the connector housing have complementary features that are configured to interact to prevent rotation of the connector housing relative to the housing.

3. The cooking system of claim 1, wherein the connector housing includes a projection extending outward therefrom and configured to extend into a channel in the exterior of the housing such that the channel engages the projection to prevent rotation of the connector housing relative to the housing in a first rotational direction.

4. The cooking system of claim 3, wherein the channel extends around the sensor port.

5. The cooking system of claim 1, wherein the connector housing includes a projecting portion extending downward from the connector housing towards the through-passage, the projecting portion having an internal surface configured to contact an external surface of the housing when the connector housing is arranged within the sensor port to thereby orient the cable toward the through-passage.

6. The cooking system of claim 1, wherein the through-passage is defined by the front exterior surface of the cooking container and an internal top surface of the housing.

7. The cooking system of claim 1, wherein the housing further includes a second internal compartment configured to receive a second cooking container therein, wherein a second interior cooking volume is defined within an interior of the second cooking container.

8. The cooking system of claim 7, wherein the first cooking container and the second cooking container are individually insertable into the first cooking compartment and the second cooking compartment respectively.

9. The cooking system of claim 7, wherein the first internal compartment and the second internal compartment are fluidly separate.

10. The cooking system of claim 7, wherein the at least one heating element includes a first heating element positioned within the first internal compartment and a second heating element positioned within the second internal compartment.

11. The cooking system of claim 10, wherein the second heating element is configured to be selectively controlled in response to an input received from the probe when the connector housing is arranged within the sensor port.

12. A sensor assembly, comprising:

a cable having a proximal end and a distal end;

a probe coupled to the distal end of the cable; and a connector housing coupled to the proximal end of the cable, the connector housing having a first projection extending therefrom in a first direction, a second projection extending therefrom in a second direction generally perpendicular to the first direction, and an electrical pin extending therefrom in the first direction, the electrical pin extending adjacent and generally parallel to the first projection, wherein, when the electrical pin is disposed within a sensor port on a cooking device, the first projection is configured to prevent rotation of the connector housing about a first axis extending in the first direction, and the second projection is configured to prevent rotation of the connector housing about a second axis extending in the second direction.

13. The sensor assembly of claim 12, wherein the second projection includes an internal surface having first and second planar portions positioned at an angle relative to one another.

14. The sensor assembly of claim 12, wherein the electrical pin has a length that is greater than a length of the first projection.

15. The sensor assembly of claim 12, wherein the cable extends from a terminal end of the second projection.

16. A method for cooking, comprising:

inserting a probe on a sensor assembly into a first cooking container;

positioning a cable extending from the probe within a through-channel formed in an upper surface of the first cooking container;

inserting a connector housing coupled to the cable into a sensor port formed in an external surface of a housing of a cooking system; and inserting the first cooking container through a front exterior surface of the housing and into a first internal compartment of the housing of the cooking system such that the cable extends from the probe within the first cooking container, is seated in the through-channel, and extends to the connector housing coupled to the sensor port on the external surface of the housing of the cooking system;

wherein features on the connector housing interact with complementary features on the housing of the cooking system to prevent rotation of the connector housing relative to the housing of the cooking system.

17. The method of claim 16, wherein rotation of the connector housing is prevented along a first axis and along a second axis extending substantially perpendicular to the first axis.

18. The method of claim 16, further comprising inserting a second cooking container having a second internal volume into a second internal compartment in the housing of the cooking system.

19. The method of claim 16, further comprising instructing the cooking system to perform at least one cooking operation, and wherein in response the cooking system activates at least one heating element disposed within the housing.

20. The method of claim 16, further comprising activating the cooking system to perform a cooking operation, and wherein the cooking system includes a heating element that is controlled in response to an input measured by the probe.

* * * * *